United States Patent [19]

Axton

[11] 4,351,348

[45] Sep. 28, 1982

[54] SURVIVAL STICK

[76] Inventor: Hoyt W. Axton, P.O. Box 614, Tahoe City, Calif. 95730

[21] Appl. No.: 109,570

[22] Filed: Jan. 4, 1980

[51] Int. Cl.[3] ..... A45B 7/00

[52] U.S. Cl. ..... 135/66

[58] Field of Search ..... 135/65, 66

[56] References Cited

U.S. PATENT DOCUMENTS

| | | | |
|---|---|---|---|
| 10,795 | 4/1851 | DeSaxe | 135/66 |
| Re. 28,067 | 7/1974 | Hyman | 135/74 |
| 66,586 | 7/1867 | Harvey | 135/65 |
| 82,949 | 10/1868 | Heylin | 135/66 |
| 139,020 | 5/1873 | Osborn | 135/66 |
| 287,170 | 10/1883 | Roovers | 135/65 |
| 442,048 | 12/1890 | Hofel | 135/65 |
| 504,326 | 9/1893 | Chapman | 135/66 |
| 1,324,554 | 12/1919 | Kozlowski | 135/66 |
| 1,618,065 | 2/1927 | Davis | 135/66 |
| 1,806,709 | 5/1931 | Rosinsky | 135/66 |
| 2,597,172 | 5/1952 | Parker | 135/66 |
| 4,002,236 | 1/1977 | Tolleson | 135/66 |

FOREIGN PATENT DOCUMENTS

| | | | |
|---|---|---|---|
| 381199 | 9/1923 | Fed. Rep. of Germany | 135/66 |
| 62043 | 10/1912 | Switzerland | 135/66 |
| 122889 | 10/1927 | Switzerland | 135/66 |
| 17849 | of 1889 | United Kingdom | 135/65 |
| 27215 | of 1912 | United Kingdom | 135/65 |

*Primary Examiner*—Reinaldo P. Machado
*Attorney, Agent, or Firm*—Dunlap & Codding

[57] ABSTRACT

A survival stick adapted for storing items having an upper section, a lower section and at least one intermediate section, the upper section, the lower section and the intermediate sections being removably connectable to form the walking stick. A compartment is formed in the intermediate section for storing items and compartments can also be formed in the upper and lower sections for storing items. One of the intermediate sections is removably connectable to a mid-point of the upper section generally between the upper and the lower ends of the upper section to form a crutch support.

2 Claims, 7 Drawing Figures

SURVIVAL STICK

BACKGROUND OF THE INVENTION

Field of the Invention

The present invention relates generally to improved walking sticks and, more particularly, but not by way of limitation, to a survival stick having removably connectable sections with compartments for storing items formed in at least some of the sections, the survival stick being convertable to a crutch structure.

DESCRIPTION OF THE PREFERRED EMBODIMENT

Figure 1:
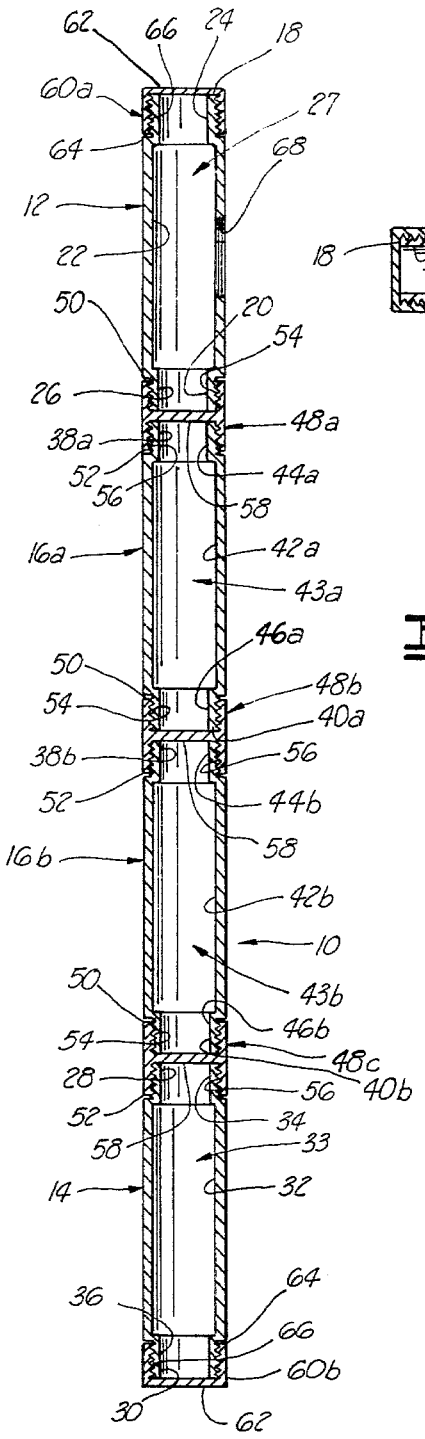
FIG. 1 is a sectional view of a survival stick constructed in accordance with the present invention.
Figure 2:
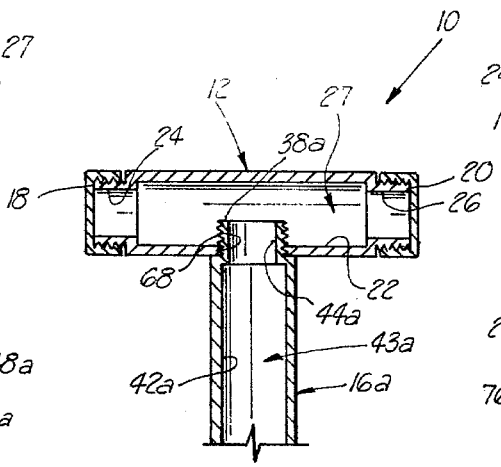
FIG. 2 is a fragmentary, sectional view of the survival stick of FIG. 1 with the upper section connected to form a crutch-like structure.

Referring to the drawings in general and to FIG. 1 in particular, shown therein and designated via the general reference numeral 10 is a survival stick constructed in accordance with the present invention. The survival stick 10 includes an upper section 12, a lower section 14 and a plurality of intermediate sections 16, only two intermediate sections being shown in the drawings and designated therein via the reference numerals **16*a* and 16*b* since the intermediate sections 16 are identical in construction. The sections 12, 14 and 16 are interconnected to form the survival stick 10. The sections 12, 14 and 16 are connectable to form a walking stick (as shown in FIG. 1) which can be utilized by an individual in various hiking or camping type activities. In addition, the sections 12, 14 and 16 each include a compartment for storing various items such as medical supplies or blankets, for example, which may be useful to an individual in various emergency situations. Also, the upper section 12 of the survival stick 10 is connectable to the uppermost intermediate sections 16*a* (as shown in FIG. 2**) to form a crutch-like structure for supporting an individual should an individual's leg become injured during such hiking or camping type activities.

The upper section 12 is constructed of a tubular material, such as aluminum tubing, for example. The upper section 12 has an upper end 18 and a lower end 20 and an opening 22 which extends through the upper section 12 intersecting the upper and lower ends 18 and 20. A portion 24 of the upper section 12 generally near the upper end 18 is tapered inwardly and a portion of the outer peripheral surface of the tapered portion 24 generally near the upper end 18 is threaded. A portion 26 of the upper section 12 generally near the lower end 20 is tapered inwardly and a portion of the outer peripheral surface of the tapered portion 26 generally near the lower end 20 is threaded. The opening 22 extending through the upper section 12 is constructed to cooperate in forming a compartment 27 in the upper section 12 for storing items. It should be noted that, in one form, the opening 22 could intersect only the lower end 20 and extend a distance through the upper section 12 generally toward the upper end 18 thereby closing the upper end portion of the opening 22, for reasons which will be made more apparent below.

The lower section 14 is constructed of a tubular material, such as aluminum tubing, for example. The lower section 14 includes an upper end 28, a lower end 30 and an opening 32. The opening 32 extends through the lower section 14 intersecting the upper and the lower ends 28 and 30. The opening 32 is constructed to cooperate in forming a compartment 33 in the lower section 14. A portion 34 of the lower section 14 generally near the upper end 28 is tapered inwardly and a portion of the outer peripheral surface of the tapered portion 34 generally near the upper end 28 is threaded. A portion 36 of the lower section 14 generally near the lower end 30 is tapered inwardly and a portion of the outer peripheral surface of the tapered portion 36 generally near the lower end 30 is threaded. It should be noted that, in one form, the opening 32 could intersect only the upper end 28 and extend a distance through the lower section 14 generally toward the lower end 30 thereby closing the lower end portion of the opening 32, for reasons which will be made more apparent below.

The intermediate sections **16*a* and 16*b* are each constructed in a similar manner and each intermediate section 16*a* and 16*b* includes an upper end 38, a lower end 40 and an opening 42 extending therethrough intersecting the upper and lower ends 38 and 40 thereof (the various portions of the intermediate sections 16*a* and 16*b* also being designated via the letters "a" and "b" respectively for identification). The opening 42 is constructed and disposed to cooperate in forming a compartment chamber 43 in the intermediate section 16 for storing items. In one form, the opening 42 could intersect only one of the upper and lower ends 28 and 40 and extend a distance through the intermediate section 16 thereby providing a closed end on each intermediate section 16*a* and 16*b***.

A portion 44 of each intermediate section **16*a* and 16*b* generally near the upper end 38 is tapered inwardly and a portion of the outer peripheral surface of the tapered portion 44 is threaded. A portion 46 of each intermediate section 16*a* and 16*b* generally near the lower end 40 is tapered inwardly and a portion of the outer peripheral surface of the tapered portion 46** is threaded.

The survival stick 10 includes a plurality of collars 48 or, more particularly, three collars **48*a*, 48*b* and 48*c* in the embodiment of the invention shown in FIGS. 1 and 2. The collars 48 are identical in construction and each collar 48 includes opposite ends 50 and 52. A first opening 54 intersects the end 50 of each collar 48 and the first opening 54 extends a distance through the collar 48 generally toward the opposite end 52. A second opening 56 intersects the end 52 of each collar 48 and the second opening 56 extends a distance through the collar 48 generally toward the opposite end 50. The openings 54 and 56 do not intersect and thus a portion 58 of each collar 48 extends across each opening 54 and 56, each portion 58 extending transversely across a central portion of one of the collars 48**.

The inner peripheral surface of each collar 48 formed by the first opening 50 is threaded and the inner peripheral surface of each collar formed by the second opening 52 is threaded. The collars 48 are constructed to cooperate in connecting the sections 12, 14 and 16 to form the survival stick 10 of the present invention.

As shown in FIG. 1, the threaded, tapered portion 26 of the upper section 12 is threadedly inserted into the first opening 50 of the collar 48*a* and the threaded, tapered portion 44*a* of the intermediate section 16*a* is threadedly inserted into the second opening 52 of the same collar 48*a*. Thus, the collar 48*a* cooperates to threadedly and removably connect the lower end 20 of the upper section 12 to the upper end 38*a* of the intermediate section 16*a*. In the connected position of the upper section 12 and the intermediate section 16*a*, the portion 58 of the collar 48*a* extends between and, in essence, closes the lower end 20 of the upper section 12 and the upper end 38*a* of the intermediate section 16*a*. Thus, the collar 48*a* and, more particularly, the portion 58 of the collar 48*a* cooperates to retain items within the compartment 27 by closing the lower end 20 of the upper section 12. Further, the portion 58 of the collar 48*a* cooperates to retain items within the compartment 43*a* of the intermediate section 16*a* by closing the upper end 38*a* of the intermediate section 16*a*.

The threaded, tapered portion 46*a* of the intermediate section 16*a* is threadedly inserted into the first opening 50 of the collar 48*b* and the threaded, tapered portion 44*b* of the intermediate section 16*b* is threadedly inserted into the second opening 52 of the same collar 48*b*. Thus, the collar 48*b* cooperates to threadedly and removably connect the lower end 40*a* of the intermediate section 16*a* to the upper end 38*b*. In the connected position of the intermediate sections 16*a* and 16*b*, the portion 58 of the collar 48*b* extends between and, in essence, closes the lower end 40*a* of the intermediate section 16*a* and the upper end 38*b* of the intermediate section 16*b*. The portion 58 of the collar 48*b* cooperates to retain items within the compartment 43*a* by closing the lower end 40*a* of the intermediate section 16*a*. The portion 58 of the collar 48*b* also cooperates to retain items within the compartment 43*b* by closing the upper end 38*b* of the intermediate section 16*b*.

The threaded, tapered portion 34 of the lower section 14 is threadedly inserted into the second opening 52 of the collar 48*c* and the threaded, tapered portion 46*b* of the intermediate section 16*b* is threadedly inserted into the first opening 50 of the collar 48*c*. The collar 48*c* cooperates to connect the lower end 40*b* of the intermediate section 16*b* to the upper end 28 of the lower section 14. In the connected position of the intermediate section 16*b* and the lower section 14, the portion 58 of the collar 48*c* extends between and, in essence, closes the lower end 40*b* of the intermediate section 16*b* and the upper end 28 of the lower section 14. The portion 58 of the collar 48*c* cooperates to retain items within the compartment 43*b* by closing the lower end 40*b* of the intermediate section 16*b*, and the portion 58 of the collar 48*c* cooperates to retain items within the compartment 33 by closing the upper end 28 of the lower section 14.

The survival stick 10 also includes two caps 60*a* and 60*b*. The caps 60*a* and 60*b* are identical in construction and each cap 60*a* and 60*b* includes a closed end 62 and an opposite, open end 64. An opening 66 is formed through the end 64 of each cap 60*a* and 60*b*, the opening 66 extending a distance through the caps and operating to form the open end 64. A portion of the inner peripheral surface formed in each cap 60*a* and 60*b* by the openings 66 is threaded.

The tapered portion 24 of the upper section 12 is threadedly inserted into the opening 66 in the caps 60*a* and the cap 60*a* thus is threadedly secured to the upper end 18 of the upper section 12. The cap 60*a* cooperates to retain items within the compartment 27 by closing the upper end 18 of the upper section 12.

The tapered portion 46*b* of the intermediate section 16*b* is threadedly inserted into the opening 66 in the cap 60*b* and the cap 60*b* thus is threadedly secured to the lower end 30 of the lower section 14. The cap 60*b* cooperates to retain items within the compartment 33 by closing the lower end 30 of the lower section 14.

An opening 68 is formed through a central portion of the upper section 12 generally midway between the upper and the lower ends 18 and 20. The opening 68 extends generally transversely with respect to the opening 22 and the opening 68 intersects the opening 22. The peripheral surface formed in the upper section 12 by the opening 68 is threaded.

In operation, the caps 60*a* can be threadedly connected to the upper section 12 and, in this position, items then can be loaded into the compartment 27, the items being retained within the compartment 27 by the cap 60*a* which closes the upper end 12 of the upper section 12. The upper end 38*a* of the intermediate section 16*a* can be threadedly connected to the collar 48*a* and then items can be loaded into the compartment 43*a*, the items being retained within the compartment 43*a* by the collar 48*a* which closes the upper end 38*a* of the intermediate section 16*a*. The upper end 38*b* of the intermediate section 16*b* can be threadedly connected to the collar 48*b* and then items can be loaded into the compartment 43*b*, the items being retained within the compartment 43*b* by the collar 48*b* which closes the upper end 38*b* of the intermediate section 16*b*. The cap 60*b* can be threadedly connected to the lower end 30 of the lower section 14 and then items can be loaded into the compartment 33 of the lower section 14, the items being retained within the compartment 33 by the caps 60*b* which closes the lower end 30 of the lower section 14.

After the compartments 27, 43*a*, 43*b* and 33 have been loaded with the appropriate items, the upper section 12 is removably connected to the intermediate section 16*a* via the collar 48*a*, the intermediate section 16*a* is removably connected to the intermediate section 16*b* via the collar 48*b* and the intermediate section 16*b* is removably connected to the lower section 14 via the collar 48*c*. In this position, the sections 12, 16*a*, 16*b* and 14 are interconnected to form a walking stick which can be utilized by an individual to assist in walking during hiking or camping or the like activities. During such activities if access to any of the compartments 27, 43*a*, 43*b* or 33 is desired for any reason, such access is readily attainable by removing either one of the caps 60*a* or 60*b* or one of the collars 48*a*, 48*b* or 48*c*. More particularly, if access is desired into one of the compartments 43*a* or 43*b* of the intermediate sections 16*a* or 16*b*, respectively, such intermediate section 16*a* or 16*b* can be unthreaded from the collar 48*a*, 48*b* or 48*c* to provide such access.

During activities such as hiking or camping or the like, it is not unusual for one to injure a leg such as via a sprain or broken bone. In such event, it can be critical that the individual have ready access to something to assist the individual's walking function. In the event of such an unfortunate occurrance, the individual simply unthreads the upper section 12 from the collar 48*a* and then removes the collar 48*a* from the intermediate section 16*a*, thereby exposing the tapered, threaded portion 44*a* of the intermediate section 16*a*. The threaded portion 44*a* then is threaded into the opening 68 in the upper section 12 thereby connecting the upper section 12 to the intermediate section 16*a* to form a crutch-like structure wherein the upper section 12 extends generally perpendicularly with respect to the intermediate sections 16*a* and 16*b* and the interconnected lower section 14, as shown in FIG. 2. In this position as shown in FIG. 2, the individual can use the survival stick 10 as a crutch to assist the individual in walking. In addition to the walking assistance, the individual may be using the survival stick 10 to walk to various remote locations and some mishap may occur wherein the individual requires some medication or a blanket or some other medical item. Utilizing the survival stick 10 of the present invention, the individual has ready access to such items, since such items are stored within the compartments 27, 43*a*, 43*b* and 33. Thus, the survival stick 10 of the present invention not only provides a practical walking stick, but the survival stick 10 can be employed to assist in various mishaps and, in some instances, the survival stick 10 may be useful in avoiding a disastrous conclusion.

Figure 3:
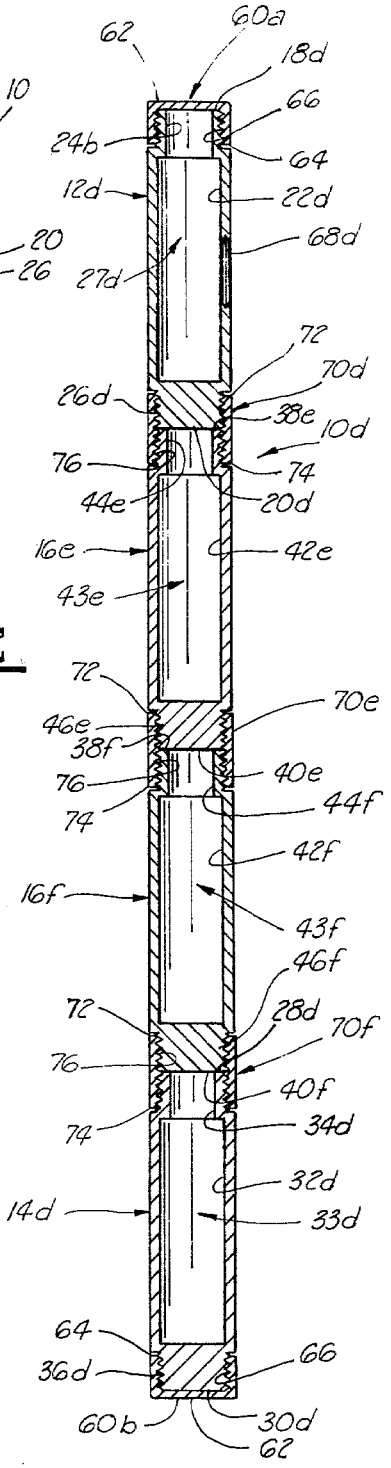
FIG. 3 is a sectional view showing a modified survival stick.

Embodiment of FIG. 3

Shown in FIG. 3 and designated via the reference numeral 10*d* is a modified survival stick similar to the survival stick 10 shown in FIGS. 1 and 2.

The upper section 12*d* is constructed exactly like the upper section 12, as shown in FIG. 1, except the opening 22*d* does not extend through the entire length of the upper section 12*d*. Rather, the opening 22*d* intersects the upper end 18*d* and extends a distance through the upper section 12*d*. Thus, the lower end 20*d* is closed and the upper end 18*d* is open.

The intermediate sections 16*e* and 16*f* are constructed exactly like the intermediate sections 16*a* and 16*b*, shown in FIG. 1, except the openings 42*e* and 42*f* do not extend through the entire length of the intermediate sections 16*a* and 16*b*, respectively. Rather, the openings 42*e* and 42*f* each intersect the upper ends 38*e* and 38*f*, respectively, and each opening 42*e* and 42*f* extends a distance through the intermediate section 16*e* and 16*f*, respectively, thereby providing a closed, lower end 40*e* and 40*f* and an open, upper end 39*e* and 38*f* in the intermediate sections 16*e* and 16*f*.

The lower section 14*d* is constructed exactly like the lower section 14, as shown in FIG. 1, except the opening 32*d* does not extend through the entire length of the lower section 14*d*. Rather, the opening 32*d* intersects the upper end 28*d* and extends a distance through the lower section 14*d*, thereby providing an open, upper end 28*d* and a closed, lower end 30*d*.

The cap 60*a* is threadedly connected to the tapered portion 24*d* of the upper section 12*d*, in a manner and for reasons exactly like that described before with respect to the upper section 12 and the cap 60*a*. The cap 60*b* is threadedly connected to the tapered portion 34*d* of the lower section 14*d*, in a manner and for reasons exactly like that described before with respect to the lower section 14 and the cap 60*b*.

The survival stick 10*d* includes three collars 70 (designated in the drawing as 70*d*, 70*e* and 70*f*, respectively). The collars 70*d*, 70*e* and 70*f* are identical in construction and the collars 70*d*, 70*e* and 70*f* are constructed similar to the collars 48*a*, 48*b* and 48*c*, shown in FIG. 1. The collars 70 each include opposite ends 72 and 74 and an opening 76 extends therethrough intersecting the opposite ends 72 and 74. The collars 70 cooperate to connect the upper section 12 to the intermediate section 16*e*, to connect the intermediate section 16*a* to the intermediate section 16*f* and to connect the intermediate section 16*f* to the lower section 14*d* in a manner exactly like that described before with respect to the collars 48 shown in FIG. 1, except the collars 70 do not include a portion extending transversely across the opening through the collar similar to the portion 58 of the collars 48, since the opening 76 extends completely through each of the collars 70 intersecting the opposite ends 72 and 74. This construction of the collar 70 is possible since one end of each of the sections 12*d*, 16*e*, 16*f* and 14*d* is closed because the opening in these sections does not extend completely through the section.

Figures 4, 5, 6, 7:
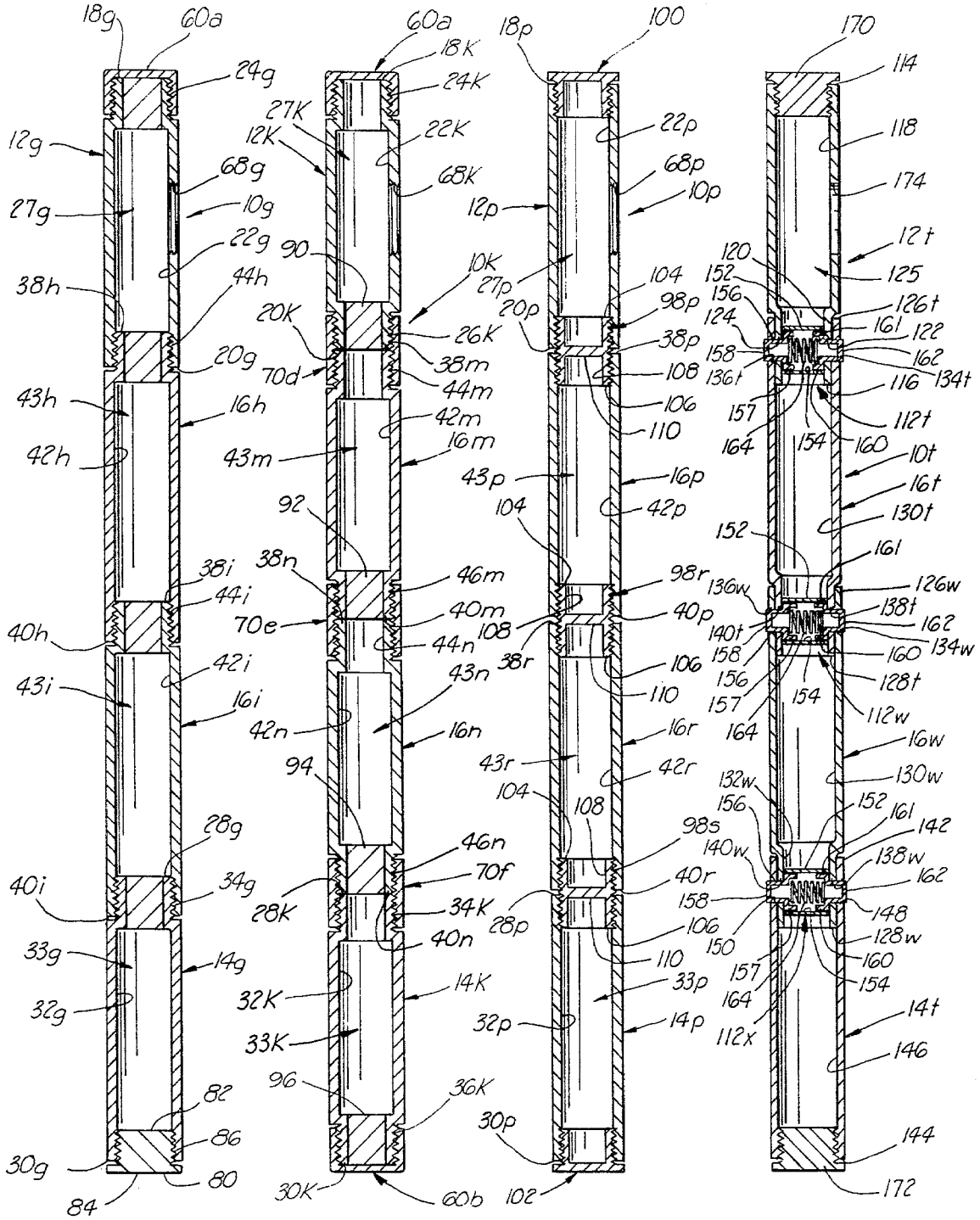
FIG. 4 is a sectional view showing another modified survival stick.
FIG. 5 is a sectional view showing yet another modified survival stick.
FIG. 6 is a sectional view showing another modified survival stick.
FIG. 7 is a sectional view showing a portion of still another modified survival stick.

Embodiment of FIG. 4

Shown in FIG. 4 is another modified survival stick 10*g* which is constructed similar to the survival sticks 10 and 10*d* described in detail before.

The survival stick 10*g* includes a modified upper section 12*g* which is constructed exactly like the upper section 12 shown in FIG. 1, except the opening 22*g* does not extend completely through the upper section 12*g*. The opening 22*g* intersects the lower end 20*g* and extends a distance through the upper section 20*g* generally toward the upper end 18*g* thereby forming a closed upper end 18*g* since the opening 22*g* does not extend through the upper end 18*g*.

A portion of the upper section 12*g* generally near the upper end 18*g* is tapered to form a tapered portion 24*g* and the outer peripheral surface of the tapered portion 24*g* is threaded. A tapered portion is not formed near the lower end 20*g* in a manner like the tapered portion 24 of the upper section 12 shown in FIG. 1. However, a portion of the inner peripheral surface formed in the upper section 12*g* by the opening 22*g* and generally near the lower end 20*g* is threaded, as shown in FIG. 4.

The lower section 14*g* is constructed exactly like the lower section 14 shown in FIG. 1, except the opening 32*g* does not extend completely through the lower section 14*g* and both ends of the lower section 14*g* are not tapered. The opening 32*g* intersects the lower end 30*g* of the lower section 14*g* and extends a distance through the lower section 14*g* generally toward the upper end 28*g* thereby forming a closed upper end 28*g* because the opening 32*g* does not extend completely through the lower section 14*g*. A threaded, tapered portion 34*g* is formed on the lower section 14*g* generally near the upper end 28*g* thereof in a manner like that described before with respect to the tapered portion 34 of the lower section 14 shown in FIG. 1.

A tapered portion is not formed on the lower section 14*g* generally near the lower end 32*g* in a manner like that described before with respect to the tapered portion 36 of the lower section 14 shown in FIG. 1. Rather, a portion of the inner peripheral surface formed in the lower section 14*g* by the opening 32*g* and generally near the lower end 30*g* is threaded, as shown in FIG. 4.

The intermediate section 16*h* is constructed similar to the intermediate section 16 shown in FIG. 1, except the opening 42*h* does not extend completely through the intermediate section 16*h* and both ends of the intermediate section 16*h* are not tapered. The opening 42*h* intersects the end 40*h* and extends a distance through the intermediate section 16h generally toward the upper end 38h thereby forming a closed upper end 38h. A tapered portion 44h is formed on the intermediate section 16h generally near the upper end 38h and a portion of the outer peripheral surface of the tapered portion 44h is threaded in a manner like that described before with respect to the tapered portion 44 of the intermediate section 16h shown in FIG. 1. A tapered portion is not formed on the intermediate section 16h generally near the lower end 40h like that described before with respect to the tapered portion 46 on the intermediate section 16 shown in FIG. 1. A portion of the inner peripheral surface formed in the intermediate section 16h by the opening 42h and generally near the lower end 40h is threaded, as shown in FIG. 4.

The intermediate section 16i is constructed exactly like the intermediate section 16 shown in FIG. 1, except the opening 42i does not extend completely through the intermediate section 16i and both ends of the intermediate section 16i are not tapered. The opening 42i intersects the lower end 40i and extends a distance through the intermediate section 16i generally toward the upper end 38i thereby forming a closed upper end 38i. A tapered portion 44i is formed on the intermediate section 16i generally near the upper end 38i and a portion of the outer peripheral surface formed by the tapered portion 44i is threaded in a manner like that described before with respect to the tapered portion 44 of the intermediate section 16 shown in FIG. 1. A tapered portion is not formed on the intermediate section 16i generally near the lower end 40i like the tapered portion 46 on the intermediate section 16i shown in FIG. 1. A portion of the inner peripheral surface formed in the intermediate section 16i by the opening 42i and generally near the lower end 40i is threaded as shown in FIG. 4.

To assemble the survival stick 10g, the cap 60a is threadedly connected to the tapered portion 24g of the upper section 12g in a manner and for reasons like that described before with respect to the cap 60a and the upper section 12 shown in FIG. 1. The tapered portion 44h of the intermediate section 16h then is threadedly inserted through the lower end 20g and into the opening 22g of the upper section 12g thereby threadedly connecting the upper section 12g to the intermediate section 16h. The tapered portion 44i of the intermediate section 16i is threadedly inserted through the lower end 40h and into the opening 42h of the intermediate section 16h to threadedly connect the intermediate sections 16h and 16i. The tapered portion 34g of the lower section 14g is threadedly inserted through the lower end 40i and into the opening 42i of the intermediate section 16i to threadedly connect the lower section 14g to the intermediate section 16i.

The survival stick 10g also includes a cap 80 having opposite ends 82 and 84. A reduced diameter portion 86 is formed on the cap 80 extending from the end 82 generally toward the end 84 thereof. A portion of the outer peripheral surface of the reduced diameter portion 86 is threaded, as shown in FIG. 4. To complete the assembly of the survival stick 10g, the reduced diameter portion 86 of the cap 80 is threadedly inserted through the lower end 30g and into the opening 32g of the lower section 14g to close the lower end 30g and complete the assembly of the survival stick 10g.

The survival stick 10g will operate in a manner like that described before with respect to the survival stick 10 (shown in FIG. 1) and 10d (shown in FIG. 3) except the modified construction of the sections 12g, 14g, 16h and 16i are such that there is no need for collars similar to the collars 40 and 70 shown in FIGS. 1 and 3.

Embodiment of FIG. 5

The survival stick 10k shown in FIG. 5 is constructed exactly like the survival stick 10d shown in FIG. 3, except: the opening 22k extends completely through the upper section 12k intersecting the upper and the lower ends 18k and 20k; the opening 42m extends completely through the intermediate section 16m intersecting the upper and the lower ends 38m and 40m; the opening 42n extends completely through the intermediate section 16n intersecting the upper and the lower ends 38n and 40n; and the opening 32k extends completely through the lower section 14k intersecting the upper and the lower ends 28k and 30k. Also, the modified survival stick 10k shown in FIG. 5 includes a first, a second, a third and a fourth insert, 90, 92, 94 and 96.

The inserts 90, 92, 94 and 96 are identical in construction. The insert 90 is disposed in the opening 22k in the upper section 12k and secured to the upper section 12k generally near the lower end 20k thereby closing the lower end 20k of the upper section 12k. The insert 92 is disposed in the opening 42m of the intermediate section 16m and the insert 92 is secured to the intermediate section 16m generally near the lower end 40m thereby closing the lower end 40m of the intermediate section 16m. The insert 94 is disposed in the opening 42n of the intermediate section 16n and the insert 94 is secured to the intermediate section 16n generally near the lower end 40n thereof thereby closing the lower end 40n of the intermediate section 16n. The insert 96 is disposed in the opening 32k in the lower section 14k and the insert 96 is secured to the lower section 14k generally near the lower end 30k thereof, thereby closing the lower end 30k of the lower section 14k.

The survival stick 10k will operate and is assembled in a manner exactly like that described before with respect to the survival stick 10d, except the inserts 90, 92, 94 and 96 constitute a separate element which must be secured to the respective sections 12k, 16m, 16n and 14k.

Embodiment of FIG. 6

Shown in FIG. 6 is another modified survival stick 10p which is constructed similar to the survival stick 10 shown in FIG. 1 and described in detail before, except the survival stick 10p includes a modified upper section 12p, a modified intermediate section 16p, a modified intermediate section 16r, a modified lower section 14p and a pair of caps 100 and 102. In addition, the survival stick 10p includes three connectors 98 which are identical in construction, the connectors being designated in FIG. 6 via the reference numerals 98p, 98r and 98s.

The upper section 12p is constructed exactly like the upper section 12 shown in FIG. 1, except the upper section 12p does not include tapered portions similar to the tapered portions 24 and 26 (shown in FIG. 1) and a portion of the inner peripheral surface formed by the opening 22p and generally near the upper end 18p of the upper section 12p is threaded, a portion of the inner peripheral surface formed by the opening 22p and generally near the lower end 20p of the upper section 12p also being threaded, as shown in FIG. 6.

The intermediate section 16p is constructed exactly like the intermediate section 16 shown in FIG. 1, except the intermediate section 16p does not include tapered portions similar to the tapered portions 44 and 46

(shown in FIG. 1) and a portion of the inner peripheral surface formed by the opening 42p and generally near the upper end 38p of the intermediate section 16p is threaded, a portion of the inner peripheral surface formed by the opening 42p and generally near the lower end 40p of the intermediate section 16p also being threaded, as shown in FIG. 6.

The intermediate section 16r is constructed similar to the intermediate section 16 shown in FIG. 1, except the intermediate section 16r does not include tapered portions similar to the tapered portions 44 and 46 (shown in FIG. 1) and a portion of the inner peripheral surface formed by the opening 42r and generally near the upper end 38r of the intermediate section 16r is threaded, a portion of the inner peripheral surface formed by the opening 42r and generally near the lower end 40r also being threaded, as shown in FIG. 6. The intermediate sections 16p and 16r are identical in construction, as shown in FIG. 6.

The lower section 14p is constructed similar to the lower section 14 shown in FIG. 1, except the lower section 14p does not include tapered portions similar to the tapered portions 44 and 46 of the lower section 14 shown in FIG. 1 and a portion of the inner peripheral surface formed by the opening 32p and generally near the upper end 28p of the lower section 14p is threaded, a portion of the inner peripheral surface formed by the opening 32p and generally near the lower end 30p of the lower section 14p also being threaded as shown in FIG. 6.

The caps 100 and 102 are each identical in construction and each of the caps 100 and 102 is constructed exactly like the cap 80 shown in FIG. 4, and described in detail before.

The connectors 98p, 98r and 98s are each identical in construction and each includes an upper end 104, a lower end 106 and an opening 108 which extends axially through the connectors intersecting the upper and the lower ends 104 and 106. A base 110 is disposed in the opening 108 of each of the connectors 98, the base 110 being disposed generally midway between the upper and the lower ends 104 and 106. In this position of the base 110, the base 110 is secured to the respective connector.

To assemble the survival stick 10p, the cap 100 is threadedly inserted through the end 18p and into the opening 22p of the upper section 12p thereby closing the upper end 18p. Then, a portion of the connector 98p generally near the upper end 104 thereof is threadedly inserted through the lower end 20p and into the opening 22p of the upper section 12p thereby threadedly connecting the connector 98p to the upper section 12p, as shown in FIG. 6. A portion of the connector 98p generally near the lower end 106 thereof is threadedly inserted through the upper end 38p and into the opening 42p of the intermediate section 16p thereby threadedly connecting the intermediate section 16p to the upper section 12p. A portion of the connector 98r generally near the upper end 104 is threadedly inserted through the lower end 40p and into the opening 42p of the intermediate section 16p thereby threadedly connecting the connector 98 to the intermediate section 16p. A portion of the connector 98r generally near the lower end 106 is threadedly inserted through the upper end 38r and into the opening 42r of the intermediate section 16r thereby threadedly connecting the intermediate sections 16p and 16r. A portion of the connector 98s generally near the upper end 104 is threadedly inserted through the lower end 40r and into the opening 42r of the intermediate section 16r thereby threadedly connecting the connector 98s to the intermediate section 16r. A portion of the connector 98s generally near the lower end 106 is threadedly inserted through the upper end 28p and into the opening 32p of the lower section 14p thereby threadedly connecting the lower section 14p to the intermediate section 16r. Finally, the cap 102 is threadedly inserted through the end 30p and into the opening 32p to threadedly secure the cap 102 to the lower section 14p, the cap 102 closing the lower end 30p of the lower section 14p.

Embodiment of FIG. 7

Shown in FIG. 7 is another modified survival stick 10t having a modified upper section 12t, two modified intermediate sections 16t and 16w and a modified lower section 14t. The modified survival stick 10t also includes three connectors 112, the connectors 112 being separately designated in FIG. 6 via the reference numerals 112t, 112w and 112x.

The upper section 12t has an upper end 114 and a lower end 116. An opening 118 is formed through the upper section 12t, the opening extending axially through the upper section 12t and intersecting the upper and the lower ends 114 and 116. A tapered portion 120 is formed on the upper section 12t generally near the lower end 116, the tapered portion 120 being tapered inwardly as shown in FIG. 7. A portion of the inner peripheral surface formed by the opening 118 generally near the upper end 114 of the upper section 12t is threaded. A pair of openings 122 and 124 are formed through the upper section 12t, each of the openings 122 and 124 being disposed generally near and spaced a distance from the lower end 116 and the openings 122 and 124 being axially aligned. The opening 118 cooperates to form a compartment 125 for storing items in a manner similar to that described before.

The intermediate sections 16t and 16w are each identical in construction and each includes an upper end 126, a lower end 128 and an opening 130 extending axially therethrough and intersecting the upper and the lower ends 126 and 128 (the various portions of the intermediate sections 16t and 16w also being designated via the references "a" and "b", respectively, for identification). A tapered portion 132 is formed on each of the intermediate sections 16t and 16w, generally near the lower end 128.

A pair of openings 134 and 136 are formed through each of the intermediate sections 16t and 16w. The openings 134 and 136 generally are aligned and spaced about 180 degrees apart, the openings 134 and 136 being disposed generally near and spaced a distance from the upper end 126. A second pair of openings 138 and 140 are formed through each of the intermediate sections 16t and 16w. The openings 138 and 140 generally are aligned and spaced about 180 degrees apart, the openings 138 and 140 being disposed near and spaced a distance from the lower end 128.

The lower section 14t is constructed similar to the lower section 14 shown in FIG. 1. The lower section 14t has an upper and a lower end 142 and 144. An opening 146 is formed through the lower section 14t, the opening 146 extending axially through the lower section 14t and intersecting the upper and the lower ends 142 and 144. A portion of the inner peripheral surface formed by the opening 146 and generally near the lower end 144 of the lower section 14t is threaded, as shown in FIG. 7. A pair of openings 148 and 150 is formed through the lower section 14*t*. The openings 148 and 150 generally are aligned and spaced about 180 degrees apart, the openings 148 and 150 being disposed generally near and spaced a distance from the upper end 142 of the lower section 14*t*.

The connectors 112 are identical in construction and each connector includes a tube 152 having an opening 154 extending axially therethrough and intersecting the opposite ends thereof. A first locking pin 156 is slidably disposed within the opening 154 of the tube 152. The first locking pin 156 includes a base 157 and a projection 158 which extends a distance from the base 157. A second locking pin 160 is slidably disposed within the opening 154 of the tube 152. The second locking pin 160 includes a base 161 and a projection 162 which extends a distance from the base 161. The locking pin 162 is slidably disposed generally near the opposite end of the tube 152 with respect to the disposition of the first locking pin 156 in the tube 152.

A spring 164 is disposed between the first and the second locking pins 156 and 160. One end of the spring engages the base 157 of the first locking pin 156 and the opposite end of the spring 164 engages the base 161 of the second locking pin 160. The spring 164 biases each of the locking pins 156 and 160 in opposite directions and in a direction generally out of the opening 154 in the tube 152.

The survival stick 10*t* includes a pair of caps 170 and 172 which are constructed exactly like the caps 100 and 102 shown in FIG. 6 and described in detail before. The cap 170 is threadedly inserted through the upper end 114 and into the opening 118 of the upper section 12*t* to threadedly secure the cap 170 to the upper section 12*t*. The cap 172 is threadedly inserted through the lower end 144 and into the opening 146 of the lower section 14*t* to threadedly secure the cap 172 to the lower section 14*t*.

As shown in FIG. 7, the connector 112*t* is disposed within the opening 118 of the upper section 12*t* and spaced a distance from the lower end 116 of the upper section 12*t*. The connector 112*t* is positioned such that the projection 158 of the first locking pin 156 projects through the opening 124 in the upper section 12*t* to a position wherein the base 157 engages a portion of the upper section 12*t* generally near the opening 124 therethrough and the projection 162 of the second locking pin 160 extends through the opening 122 in the upper section 12*t* to a position wherein the base 161 of the second locking pin 160 engages a portion of the upper section 12*t* generally near the opening 122. In this position, the tube 152 is securedly connected to the upper section 12*t* and the spring 164 of the connector 112*t* functions to biasingly move the first and the second projections to a position wherein the bases 157 and 161 of the first and the second projections 158 and 162, respectively, each engage a portion of the upper section 12*t* with the projection 158 extending through the opening 124 and a distance beyond the outer wall of the upper section 12*t* and with the projection 162 extending through the opening 122 a distance beyond the outer wall of the upper section 12*t*. The first and the second locking pins 156 and 160 cooperate to secure the connector 112*t* in an assembled position within the opening 118 of the upper section 12*t* via the projections 158 and 162 extending through the openings 124 and 122, respectively.

The connector 112*w* is disposed in the opening 130*t* of the intermediate section 16*t* to a position wherein the projection 158 of the first locking pin 156 extends through the opening 140 to a position wherein the base 157 engages a portion of the intermediate section 16*t* generally about the opening 140 and wherein the projection 162 extends through the opening 138 in the intermediate section 16*t* to a position wherein the base 161 engages a portion of the intermediate section 16*t* generally about the opening 138. The spring 164 biases each of the locking pins 156 and 160 in opposite directions to maintain the projections 158 and 162 extending through the openings 140 and 138, respectively. Thus, the first and the second locking pins 156 and 160 cooperate to secure the connector 112*w* within the intermediate section 16*t* via the engagement between the locking pins 156 and 160 and the intermediate section 16*t*.

The connector 112*x* is disposed within the opening 130*w* of the intermediate section 16*w* and positioned therein such that the projection 158 of the first locking pin 156 extends through the opening 140*w* and the projection 162 on the second locking pin 160 extends through the opening 138*w*. The spring 164 biases the first and the second locking pins 156 and 160 to maintain the projections 158 and 162 extending through the openings 140*w* and 138*w*, respectively. Thus, the first and the second locking pins 156 and 160 cooperate to secure the connector 112*x* positioned within the opening 130*w* of the intermediate sections 16*w*.

After the cap 170 has been threadedly secured to the upper section 12*t*, the tapered portion 120 of the upper section 12*t* is inserted through the upper end 126*t* of the intermediate section 16*t* to a position wherein the openings 122 and 124 in the upper section 12*t* are aligned with the openings 134*t* and 136*t* in the intermediate section 16*t*. When the tapered portion 120 of the upper section 12*t* is inserted into the opening 130*t* of the intermediate section 16*t*, the first and the second locking pins 156 and 168 each engage a portion of the intermediate section 16*t*. The engagement between the first and the second locking pins 156 and 160 and portions of the intermediate section 16*t* result in the first locking pin 156 being biased in a direction generally toward the second locking pin 160 and the second locking pin 160 being biased in a direction generally toward the first locking pin 156 to a position wherein the tapered portion 120 can be inserted into the opening 130*t* of the intermediate section 16*t*. After the tapered portion 120 of the upper section 12*t* has been inserted into the opening 130*t* to a position wherein the openings 122 and 124 in the upper section 12*t* are aligned with the openings 134*t* and 136*t*, respectively, in the intermediate section 16*t*, the spring 164 in the connector 112*t* biases the first locking pin 156 to a position wherein the projection 158 extends through the openings 124 and 136*t* and the spring 164 biases the second locking pin 160 to a position wherein the projection 162 extends through the opening 122 and 134*t*. In this position, the upper section 12*t* is connected to the intermedite section 16*t* by the projections 158 and 162.

After the upper section 12*t* has been removably connected to the intermediate section 16*t* by the connector 112*t*, the tapered portion 132*t* of the intermediate section 16*t* is inserted through the upper end 126*w* and into the opening 130*w* of the intermediate section 16*w* to a position wherein the openings 138*t* and 140*t* in the intermediate section 16*t* are aligned with the openings 134*w* and 136*w* in the intermediate section 130*w*. In this position, the spring 164 biases the first locking pin 156 to a position wherein the projection 158 extends through the aligned openings 140*t* and 136*w* and biases the second locking pin 160 to a position wherein the projection 162 extends through the aligned openings 138*t* and 134*w*. Thus, the intermediate section 16*t* is connected to the intermediate section 16*w* by the projections 158 and 162 extending through the aligned openings 136*w* and 140*t* and 134*w* and 138*t*, respectively.

After the upper section 12*t*, the intermediate section 16*t* and the intermediate section 16*w* have been connected as described before, the tapered portion 132*w* is inserted through the upper end 142 and through the opening 146 of the lower section 14*t* to a position wherein the opening 140*w* is aligned with the opening 150 and the opening 138*w* is aligned with the opening 148. In this position, the spring 164 biases the first locking pin 156 to a position wherein the projection 158 extends through the aligned openings 140*w* and 150 and the spring 164 biases the second locking pin 160 to a position wherein the projection 162 extends through the aligned openings 138*w* and 148. Thus, the intermediate section 16*w* is connected to the lower section 14*t* by the projections 158 and 162 extending through the aligned openings 140*w* and 150 and the aligned openings 138*w* and 148, respectively.

The various sections of the survival stick 10*t* are disconnected to gain access to the various compartments in a similar manner. For example, if it is desired to disconnect the upper section 12*t* from the intermediate section 16*t*, a force is applied to the projections 158 moving the projection 158 out of the opening 136*t* and a force is applied to the projection 162 moving the projection 162 out of the opening 134*t*. In this position, the upper section 12*t* can be removed from the intermediate section 16*t*. As mentioned before, the remaining sections are separated in a manner similar to that described before with respect to the upper section 12*t* and the intermediate section 16*t*.

A threaded opening 174 is formed throughout the upper section 12*t*, the opening 174 being positioned generally midway between the upper and the lower ends 114 and 116. A portion of the outer peripheral surface of the intermediate section 16*t* generally near the upper end 126 is threaded. The upper section 12*t* can be disconnected from the intermediate section 16*t* and the threaded upper end 126 of the intermediate section 16*t* can be threadedly inserted into the opening 174, thereby connecting the upper section 12*t* to the intermediate section 16*t* to form a crutch-like structure for reasons described before.

It should be noted that, although the various survival sticks have been described herein as including two intermediate sections, it is contemplated that a commercial survival stick may include more or less intermediate sections, as desired in a particular construction.

Changes may be made in the construction and operation of the various elements and assemblies described herein without departing from the spirit and the scope of the invention as defined in the following claims.

What is claimed is:

1. A survival stick adapted for storing items comprising:

an upper section having an upper end, a lower end and an opening extending through the upper end and the lower end thereof and extending a distance therethrough, the opening being shaped and disposed to form a compartment in the upper section adapted for storing items;

a lower section having an upper end, a lower end and an opening extending through the upper end and the lower end thereof and extending a distance therethrough, the opening being shaped and disposed to form a compartment in the lower section adapted for storing items;

at least one intermediate section, each intermediate section having an upper end, a lower end and an opening extending through the upper end and the lower end thereof and extending a distance therethrough, the opening being shaped and disposed to form a compartment in the intermediate section generally between the upper and the lower ends, the compartment being adapted for storing items, the upper end of one of the intermediate sections being removably connectable to the lower end of the upper section and the lower end of one of the intermediate sections being removably connectable to the upper end of the lower section and the upper end of the remaining intermediate sections being removably connectable to the lower end of the remaining intermediate sections for removably connecting the upper section, the intermediate section and the lower section to form a survival stick; and at least two collars, each having a base, one collar being insertable within a portion of the opening in the upper sections generally near the lower end of the upper section for connecting the collar to the upper sections and insertable within a portion of the opening in one of the intermediate sections generally near the upper end of the intermediate section for connecting the collar to the intermediate section thereby connecting the upper section to one of the intermediate sections, and one of the collars being insertable within a portion of the opening in the lower section generally near the upper end of the lower section for connecting the collar to the lower section and insertable with the opening in one of the intermediate sections generally near the lower end of the intermediate section for connecting the collar to the intermediate section and for connecting the lower section to one of the intermediate sections.

2. The survival stick of claim 1 defined further to include:

means for removably connecting the upper end of one of the intermediate sections to the upper section at a mid-point generally between the upper and the lower ends of the upper section for adapting the survival stick to be used as a crutch-like support.

* * * * *